US009287656B2

(12) United States Patent
Crozier et al.

(10) Patent No.: US 9,287,656 B2
(45) Date of Patent: Mar. 15, 2016

(54) HEAT DISSIPATING ELECTRICAL CONNECTOR

(71) Applicant: Amphenol Corporation, Wallingford, CT (US)

(72) Inventors: Paul M. Crozier, San Jose, CA (US); John K. Griffiths, Salt Lake City, UT (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 14/076,533

(22) Filed: Nov. 11, 2013

(65) Prior Publication Data

US 2015/0132991 A1 May 14, 2015

(51) Int. Cl.

| | |
|---|---|
| ***H01R 13/00*** | (2006.01) |
| ***H01R 13/533*** | (2006.01) |
| ***H01R 12/70*** | (2011.01) |
| ***H01R 12/71*** | (2011.01) |
| *H01R 12/58* | (2011.01) |

(52) U.S. Cl.

CPC ..... *H01R 13/533* (2013.01); *H01R 12/7088* (2013.01); *H01R 12/716* (2013.01); *H01R 12/585* (2013.01)

(58) Field of Classification Search

CPC ..... H01R 13/533; H01R 12/716; H01R 12/7088; H05K 3/0061

USPC ..... 439/487, 485; 174/16.3

See application file for complete search history.

(56) References Cited

U.S. PATENT DOCUMENTS

| | | | | |
|---|---|---|---|---|
| 3,582,865 | A * | 6/1971 | Franck | H05K 7/1007 361/702 |
| 4,736,273 | A | 4/1988 | Vertongen et al. | |
| 5,055,055 | A * | 10/1991 | Bakker | 439/78 |
| 6,252,773 | B1 * | 6/2001 | Werner | 361/704 |
| 7,182,642 | B2 | 2/2007 | Ngo et al. | |
| 7,476,108 | B2 | 1/2009 | Swain et al. | |
| 7,539,018 | B2 | 5/2009 | Murr et al. | |
| 7,817,426 | B2 * | 10/2010 | Tamori | 361/704 |
| 8,053,285 | B2 | 11/2011 | Haga et al. | |
| 8,382,509 | B2 | 2/2013 | David et al. | |
| 8,439,713 | B2 | 5/2013 | Chiu et al. | |
| 2001/0036685 | A1 | 11/2001 | Takano | |
| 2003/0082945 | A1 | 5/2003 | Belady et al. | |
| 2006/0035488 | A1 | 2/2006 | Bosco et al. | |
| 2010/0144172 | A1 | 6/2010 | Pavlovic | |
| 2013/0109224 | A1 | 5/2013 | Chin et al. | |

* cited by examiner

*Primary Examiner* — Neil Abrams
*Assistant Examiner* — Travis Chambers
(74) *Attorney, Agent, or Firm* — Blank Rome LLP

(57) ABSTRACT

An electrical connector that includes a terminal adapted to mate with another terminal and at least one heat dissipating element that has opposing ends and an opening therebetween. At least one of the ends includes at least one printed circuit board engagement member configured to engage a printed circuit board for electrical current transfer. The opening receives the terminal such that heat dissipating element substantially surrounds and contacts the terminal.

22 Claims, 5 Drawing Sheets

HEAT DISSIPATING ELECTRICAL CONNECTOR

FIELD OF THE INVENTION

The present invention relates to an electrical connector, such as a high current power connector, that has heat dissipating elements.

BACKGROUND OF THE INVENTION

Electrical connectors, particularly high current power connectors, generate heat which can inhibit the electrical characteristics and performance of the connector. Excessive heat causes a safety concern and a degradation of electrical performance by increasing resistivity of the electric circuit. As a result, effective heat dissipation, particularly with respect to high current power connectors, is needed.

SUMMARY OF THE INVENTION

Accordingly, the present invention provides an electrical connector that includes a terminal adapted to mate with another terminal and at least one heat dissipating element that has opposing ends and an opening therebetween. At least one of the ends includes a printed circuit board engagement member configured to engage a printed circuit board for electrical current transfer. The opening receives the terminal such that heat dissipating element substantially surrounds and contacts the terminal.

The present invention may also provide an electrical connector that includes a terminal adapted to mate with another terminal and an array of heat dissipating elements. Each of the heat dissipating elements has opposing ends and an opening therebetween. The openings of said heat dissipating elements are axially aligned to receive the terminal such that the heat dissipating elements substantially surround and contact the terminal. At least one of the heat dissipating elements has a printed circuit board engagement member configured to engage a printed circuit board.

The present invention may further provide a high current power connector that includes a socket terminal or a pin terminal and an array of primary and secondary metal plates. Adjacent faces of the primary and secondary metal plates are engaged to one another. Each of the primary and secondary plates has opposing ends and an opening therebetween. The openings of the primary and secondary metal plates are axially aligned to receive the socket terminal or the pin terminal such that the primary and secondary metal plates substantially surround the socket terminal or said pin terminal. Each of the primary metal plates includes printed circuit board engagement member configured to engage a printed circuit board at one of its opposing ends. The primary metal plates may be larger than the secondary metal plates, thereby defining a plurality of fins. Each of the primary and secondary metal plates is in contact with the socket terminal or the pin terminal for heat dissipation.

With those and other objects, advantages, and features of the invention that may become hereinafter apparent, the nature of the invention may be more clearly understood by reference to the following detailed description of the invention, the appended claims, and the several drawings attached herein.

DETAILED DESCRIPTION OF THE PREFERRED EMBODIMENTS

Figure 1:
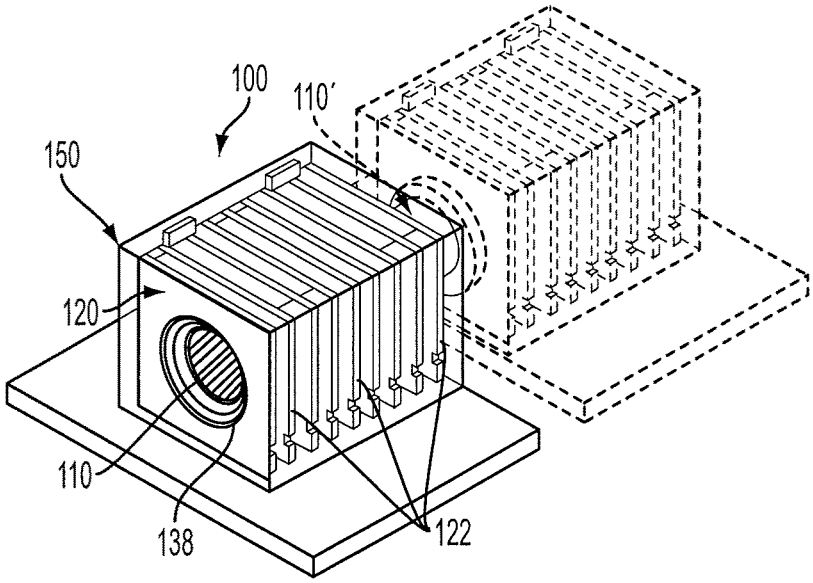
FIG. 1 is a perspective view of a heat dissipating electrical connector according to an exemplary embodiment of the present invention, showing the electrical connector engaged with a mating connector.
Figure 2:
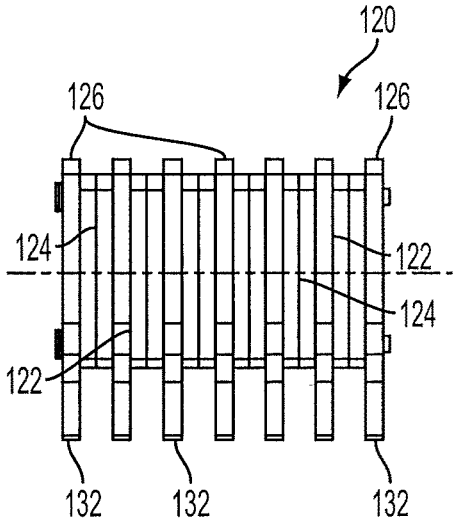
FIG. 2 is a side elevational view of the heat dissipating elements of the electrical connector illustrated in FIG. 1.
Figure 3:
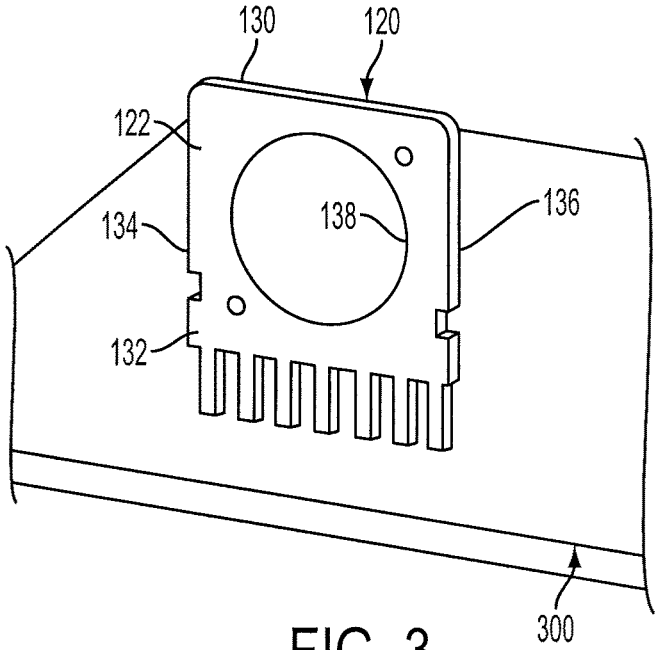
FIG. 3 is a perspective view of one of the heat dissipating elements illustrated in FIG. 2, showing the heat dissipating element mounted to a printed circuit board.

Referring to FIGS. 1-3, 4A and 4B, an electrical connector 100 according to an exemplary embodiment of the present invention has improved heat dissipation, particularly for high current power applications, such as with currents greater than 30 amperes. The connector 100 may be adapted to mount to a printed circuit board 300, as seen in FIGS. 1 and 3.

In general, the connector 100 includes a terminal 110 that is surrounded by at least one heat dissipating element 120. The terminal 110 may be a socket adapted to receive a mating pin. The socket 110 may be a RADSOK® type socket, for example, such as the RADSOK® sold by Amphenol Corporation. The RADSOK® is a stamped and formed flat grid socket uniquely twisted into a hyperbolic geometry to provide robust and high density contact to a mating pin. Alternatively, the terminal may be a pin 110' adapted to be inserted into a mating socket.

As seen in FIGS. 1 and 2, in a preferred embodiment, the terminal is surrounded by an array of heat dissipating elements 120. Each heat dissipating element 120 contacts the terminal to transfer high current created by the terminal to the printed circuit board. The heat dissipating elements 120 also serve to transfer electrical current to the printed circuit, thereby integrating the functions of heat dissipation and current transfer in one element. The array of heat dissipating elements 120 may include primary and secondary heat dissipating metal plates 122 and 124, as best seen in FIG. 2. The metal plates may be formed of a copper or aluminum alloy, for example. The primary metal plates 122 are preferably larger than the secondary metal plates 124, thereby creating heat dissipating fins 126 opposite the printed circuit board 300. The difference in shape of the adjacent first and second plates creates additional surface area at and in between the fins 126 for improved heat dissipation. Adjacent faces of the plates 122 and 124 in the array of heat dissipating elements 120 are coupled to one another in any known manner, such as by press-fit interference, welding or fastening by screws. The plates may be arranged, for example, such that two secondary plates 124 are sandwiched between two primary plates 122, as seen in FIG. 2.

Figure 4A:
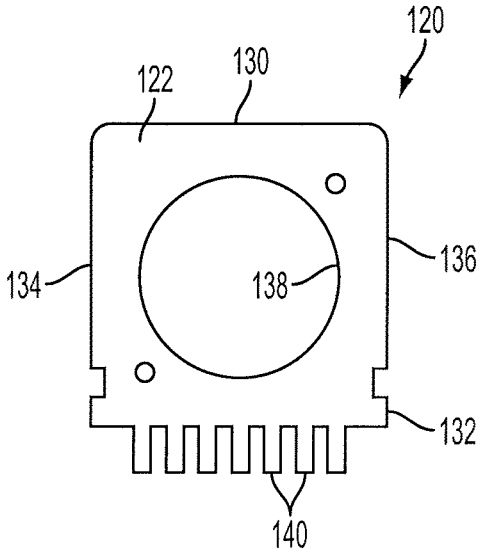
FIG. 4A is an elevational view of one of the heat dissipating elements illustrated in FIG. 3.
Figure 4B:
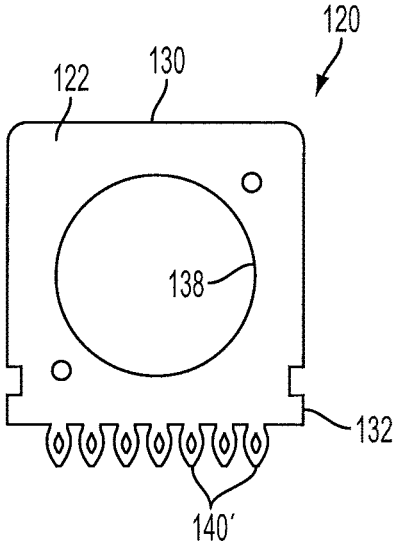
FIG. 4B is an elevational view of an alternative heat dissipating element in accordance with another exemplary embodiment of the present invention.

Each primary heat dissipating element 122 has opposing ends 130 and 132 that extend between first and second side edges 134 and 136, as seen in FIG. 4A. Each plate 122 also has opposite faces 134 and 136, as best seen in FIG. 2. Each plate 122 includes an opening 138 that is generally centrally located in the plate 122 and sized to receive the terminal 110. The ends 132 of each plate 122 have one or more engagement members configured to engage the print circuit board 300. In a preferred embodiment, the engagement members are integral with each plate 122. The connection between the members of the plates 122 with the board 300 not only secures the plates 122 to the board but also provides a contact path for heat transfer. The engagement members of each plate 122 may be, for example, solder tails 140 extending from the ends 132, as seen in FIG. 4A, that are soldered to the printed circuit board 300. Alternatively, the engagement members of each plate 122 may be provided with complaint pins 140', as seen in FIG. 4B, extending therefrom that are press-fit into the printed circuit board 300. The metal plates 122 are mounted to the circuit board 300 via the engagement members 133 such that the metal plates are generally perpendicularly oriented with respect to the circuit board 300.

Similar to the primary plates 122, each secondary plate 124 includes an opening for accommodating the terminal. The secondary plates 124 do not need to engage the printed circuit board and as such preferably do not include tails or pins for engaging the board. The openings 138 of the primary plates 122 and the openings in the secondary plates 124 are coaxially aligned so that the terminal 110 can be received in the array of heat dissipating elements, as seen in FIG. 1. The inner diameter of each opening of the plates 122 and 124 is sized such that when the terminal 110 is received therein, contact is made between the plates 122 and the terminal 110 to provide heat transfer.

Figure 5:
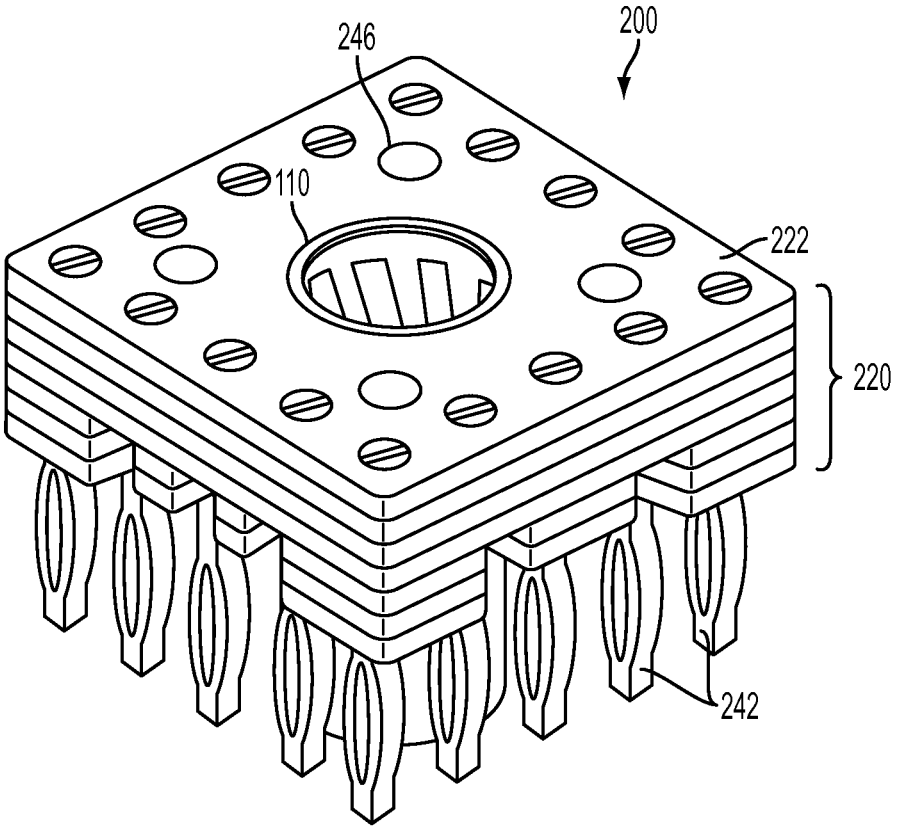
FIG. 5 is a perspective view of a heat dissipating electrical connector according to an alternative embodiment of the present invention.
Figure 6:
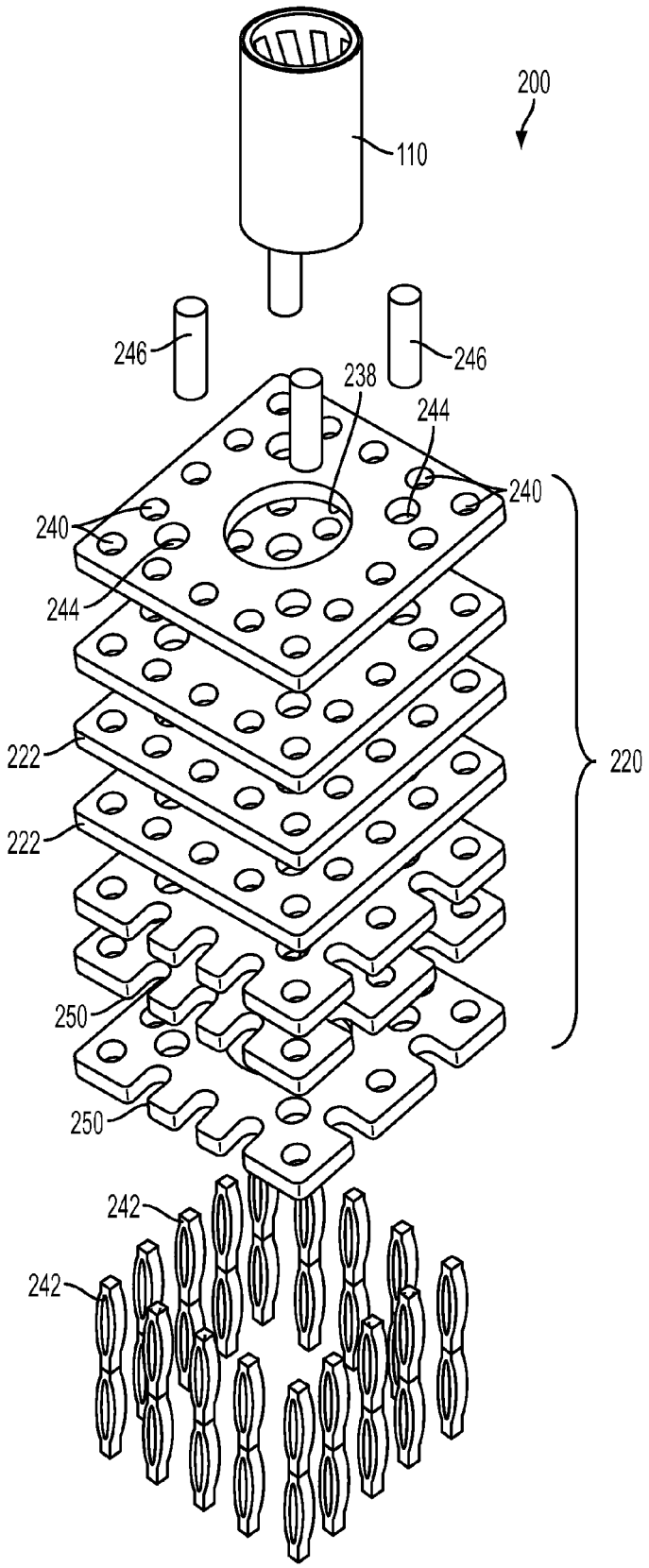
FIG. 6 is an exploded perspective view of the heat dissipating electrical connector illustrated in FIG. 5.

FIGS. 5 and 6 illustrate a heat dissipating electrical connector 200 according to an alternative embodiment of the present invention. The connector 200 is similar to the connector 100 of the first embodiment in that is also includes one or more heat dissipating elements 220 surrounding the terminal 110. Each heat dissipating element 220 may be a metal plate 222 with a central opening 238 sized to receive and contact the terminal 110, as seen in FIG. 5, similar to the openings 138 of the first embodiment. Each metal plate 222 may also include a plurality of holes 240 at an end thereof, and preferably along a perimeter thereof for receiving engagement members 242 configured to engage the printed circuit board 300 (FIG. 3). The engagement members 242 are preferably pins that press-fit into the holes 240 of the plates 222 at one end thereof. The pins 242 when inserted into the holes 240 are substantially perpendicular to the plates 222. The opposite ends of the pins 242 press-fit into the board 300.

The metal plates 222 may have generally the same size and stack one on top of the other. The stack of plates 222 provides a significant conductive mass for dissipating thermal heat. Each plate 222 includes fastener holes 244 for receiving fasteners 246 to secure the plates together. When the plates are stacked together, the openings 238 align with one another to receive the terminal 110, the holes 240 align with one another to receive the pins 242, and the fastener holes 244 align with one another to receive the fasteners 246. Some of the plates 222 may include cut-outs 250 at one or more edges to provide a location for an optional protective cover to be mounted to the stacked plates 222. When mounted on the board 300, the plates 222 are generally oriented parallel to the board 300.

Although certain presently preferred embodiments of the disclosed invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law. For example, although it is preferable that the primary and secondary plates 122 and 124 varying size, the sizes of the plates 122 and 124 may be uniform. Also, the secondary plates 124 may be eliminated such that the array of heat dissipating elements 120 include only the primary plates 122.

What is claimed is:

1. An electrical connector, comprising:

a terminal adapted to mate with another terminal, said terminal being a socket or a pin; and at least one heat dissipating element having opposing ends and an opening therebetween, at least one of said ends including at least one printed circuit board engagement member configured to engage a printed circuit board for electrical current transfer, and said opening receiving said terminal such that heat dissipating element substantially surrounds and contacts said terminal.

2. An electrical connector according to claim 1, further comprising a plurality of heat dissipating elements surrounding said terminal.

3. An electrical connector according to claim 1, further comprising a cover disposed over said heat dissipating element.

4. An electrical connector according to claim 1, wherein said heat dissipating element is a metal plate.

5. An electrical connector according to claim 4, wherein said metal plate is formed of a copper or aluminum alloy.

6. An electrical connector according to claim 4, wherein said printed circuit board engagement member is one of a solder tail or press-fit pin.

7. An electrical connector according to claim 6, wherein said printed circuit board engagement member is integral with said metal plate.

8. An electrical connector according to claim 6, wherein said printed circuit board engagement member is press-fit pin that is substantially perpendicular to said metal plate.

9. An electrical connector according to claim 8, wherein said metal plate includes a hole for receiving said press-fit pin.

10. An electrical connector, comprising:

a terminal adapted to mate with another terminal; and an array of heat dissipating elements, each of said heat dissipating elements having opposing ends and an opening therebetween, said openings of said heat dissipating elements being axially aligned to receive said terminal such that said heat dissipating elements substantially surround and contact said terminal, and at least one of said heat dissipating elements including at least one engagement member configured to engage a printed circuit board.

11. An electrical connector according to claim 10, wherein said terminal is one of a socket or a pin.

12. An electrical connector according to claim 10, wherein each of said heat dissipating elements is a metal plate.

13. An electrical connector according to claim 12, wherein said metal plate is formed of copper or aluminum alloy.

14. An electrical connector according to claim 10, wherein said array of heat dissipating elements including primary and secondary metal plates, said primary metal plates are larger than said secondary metal plates, thereby defining a plurality of fins.

15. An electrical connector according to claim 14, wherein said metal plates are engaged to one another by one of press-fit interference, welding, or screwing.

16. An electrical connector according to claim 10, wherein said plurality of printed circuit board engagement members is one of a plurality of solder tails or a plurality of press-fit pins.

17. An electrical connector according to claim 16, wherein said plurality of printed circuit board engagement members are integral with said metal plate.

18. A high current power connector, comprising:

a socket terminal or a pin terminal; and an array of primary and secondary metal plates wherein adjacent faces of said primary and secondary metal plates being engaged to one another, each of said primary and secondary plates having opposing ends and an opening therebetween, said openings of said primary and secondary metal plates being axially aligned to receive said socket terminal or said pin terminal such that said primary and secondary metal plates substantially surround said socket terminal or said pin terminal, each of said primary metal plates having a plurality of engagement members configured to engage a printed circuit board at one of said opposing ends, and said primary metal plates being larger than said secondary metal plates, thereby defining a plurality of fins, and wherein each of said primary and secondary metal plates being in contact with said socket terminal or said pin terminal for heat dissipation.

19. An electrical connector according to claim 18, wherein said engagement members are integral with said metal plates.

20. An electrical connector, comprising:

a terminal adapted to mate with another terminal; and at least one heat dissipating element having opposing ends and an opening therebetween, at least one of said ends including at least one printed circuit board engagement member configured to engage a printed circuit board for electrical current transfer, said printed circuit board engagement member being one of a solder tail or press-fit pin and said opening receiving said terminal such that heat dissipating element substantially surrounds and contacts said terminal, wherein said heat dissipating element is a metal plate and said printed circuit board engagement member is integral with said metal plate.

21. An electrical connector, comprising;

a terminal adapted to mate with another terminal, said terminal being one of a socket or a pin; and at least one heat dissipating element having opposing ends and an opening therebetween, at least one of said ends including at least one printed circuit board engagement member configured to engage a printed circuit board for electrical current transfer, and said opening receiving said terminal such that heat dissipating element substantially surrounds and contacts said terminal, wherein said heat dissipating element is a metal plate.

22. An electrical connector, comprising;

a terminal adapted to mate with another terminal; and a plurality of heat dissipating elements surrounding said terminal, at least one of said heat dissipating elements having opposing ends and an opening therebetween, at least one of said ends including at least one printed circuit board engagement member configured to engage a printed circuit board for electrical current transfer, and said opening receiving said terminal such that heat dissipating element substantially surrounds and contacts said terminal.

* * * * *